United States Patent [19]

Miyaoka

[11] Patent Number: 4,508,108

[45] Date of Patent: Apr. 2, 1985

[54] ADJUSTABLE BODY BRUSH AND MASSAGER

[76] Inventor: Eikichi Miyaoka, 1-12-3 Nakajujo, Kita-ku, Tokyo 114, Japan

[21] Appl. No.: 423,235

[22] Filed: Sep. 24, 1982

[30] Foreign Application Priority Data

Sep. 28, 1981 [JP] Japan ..... 56-142533[U]

[51] Int. Cl.[3] ..... A61H 9/00

[52] U.S. Cl. ..... 128/65; 128/62 R; 15/176; 15/145

[58] Field of Search ..... 128/62 R, 65, 44; 15/144 B, 110 R, 143 R, 144 R, 143 B, 145, 176; 132/150; 401/6, 268; D24/36; D4/19, 29, 31, 32; 248/118

[56] References Cited

U.S. PATENT DOCUMENTS

| | | | |
|---|---|---|---|
| D. 180,848 | 8/1957 | Scholl | D4/32 |
| 1,598,224 | 8/1926 | Van Sant | 15/110 |
| 2,097,461 | 11/1937 | Johnson | 401/268 |
| 2,184,827 | 12/1939 | Willmot | 15/144 B |
| 2,272,151 | 2/1942 | Hertzberg | D4/31 |
| 2,641,012 | 6/1953 | Storrs | 15/144 B |
| 2,932,047 | 4/1960 | Johnston | 15/143 B |
| 3,103,027 | 9/1963 | Birch | 15/110 |
| 3,729,762 | 5/1973 | Roth | 15/114 B |
| 3,935,611 | 2/1976 | Locher | 15/114 R |
| 3,943,921 | 3/1976 | Colk | 15/110 |
| 4,325,157 | 4/1982 | Balint et al. | 15/144 B |
| 4,390,011 | 1/1983 | Evans | 248/118 |

FOREIGN PATENT DOCUMENTS

| | | | |
|---|---|---|---|
| 826442 | 1/1952 | Fed. Rep. of Germany | 15/144 B |
| 32920 | 4/1963 | Finland | 15/143 B |
| 590855 | 7/1947 | United Kingdom | 15/144 B |

*Primary Examiner*—Richard J. Apley
*Assistant Examiner*—H. Macey
*Attorney, Agent, or Firm*—James J. Ralabate

[57] ABSTRACT

A brush-massager device having an extensible handle wherein the handle is slidably mounted within a tunnel defined by a disc support unit which supports the massaging face of the device.

The handle has a spring-loaded button operatively associated with either of two apertures associated with the tunnel.

10 Claims, 9 Drawing Figures

ADJUSTABLE BODY BRUSH AND MASSAGER

BACKGROUND OF THE INVENTION

This invention relates to an adjustable body brush, and more particularly, to a brush having unique properties for total cleansing and massaging.

It is known to have adjustable brushes in any situation where a conventional brush is used. For example, there are brushes used in painting, cleaning clothing and even body brushes. Many of the brushes used on the human body are difficult to use in that they are invariably too short to reach the back or, in many instances, too long for convenient use if designed as a back brush.

There are also massagers that have been sold that are quite bulky and not convenient to use. The smaller massagers are complex and expensive, and their wide spread commercial use has not been realized. In other instances, the massagers used are rigid, nonflexible tools or devices that could cause discomfort in the individual using it. The more reliable massagers are used professionally and as noted above are comparatively expensive to use.

The present invention fills a need for a device capable of use as both a cleansing brush and body massager, and yet not difficult to use or expensive to acquire.

The present brush-massager comprises many unique features of both a brush and massager. The face or disc of the device is made up of soft conventional bristles surrounded by flexible nipples or projections. Attached to the disc is an adjustable handle that can be made long enough to scrub and massage the back, or can be made short enough to be used as a hand brush. The construction is relatively simple, yet effective.

SUMMARY OF THE INVENTION

It is therefore an object of this invention to provide a brush-massager devoid of the above-noted disadvantages.

Another object of this invention is to provide a brush-massager that is relatively simple in construction but effective in operation.

A further object of this invention is to provide a brush that will hold soap lather in soft bristles without a need for substantial amounts of soap.

Another further object of this invention is to provide an easily adjusted brush that can be conveniently used in cleansing the human body.

Another object is to provide a device that will effectuate simultaneously both a body cleansing and a body massaging action when used.

Still a further object of this invention is to provide a brush-massager having a configuration that will effectively reach the difficult parts of the human body when in use.

The foregoing objects and others are accomplished in accordance with this invention by providing a body brush-massager comprising a front side disc containing both bristles and projections. This disc portion is in a disc support which is movably attached to a handle portion having apertures on both of its extreme parts of the handle. The disc portion contains a plurality of bristles and flexible massaging nipples or projections which not only cause a massaging action but also work with the bristles to cause a sudsing action when soap is used. The handle contains a spring loaded button or catch which mates with the apertures in the disc support to lock the disc support to the handle portion. To unlock the handle from the disc support, one will merely press down on the spring loaded button thereby releasing the disc support means from the handle. The handle is curved at each terminal portion to conform to the curvature of the human back to facilitate use in scrubbing or massaging the back. The grip portion of the handle has a raised contour to prevent the hand from slipping when in use with soap and water. Also, this elevated grip portion facilitates applying pressure to the entire brush-massager when it is required during use. The handle portion contains an aperture at its lower grip in order to permit the brush-massager to be hung up when not in use. The length of the handle can vary depending on the desired use. If a stronger handle is desired, the handle portion could contain two spring loaded buttons that will fit into and mate with the two corresponding apertures in the disc support means. If more convenient, the handle portion could contain the apertures and the disc support means could contain the mating buttons. In the shorter handle adjustment or version of this invention, the spring loaded button locks into and mates with the upper aperture.

The handle fits into the lower base portion of the disc support and is pushed upward into the aligned tunnel or opening in the disc support. When it reaches the upper portion of the disc support, the handle is locked in place when the spring loaded button aligns with and is locked into the lower aperture in the disc support. The disc support may be disengaged from the handle merely by pushing down on the bottom and pulling the handle so that the button is no longer aligned with either aperture.

The handle can be set at its longest extension by pushing the handle up into the disc support and snapping the button located at its upper portion into the lower aperture of the disc support. The handle also can be set at its shorter setting by locking or snapping the button into the upper aperture of the disc support. The disc support can be completely separated from the handle by pulling the handle out of it completely and unlocking the buttons. Thus, the disc support itself can be used as a hand held brush-massager by using the raised elongation at the top and its neck portion as the hand grip portion or means.

The disc contains a plurality of elongated rubber or flexible projections or nipples that facilitate the massaging action and adjacent thereto and dispersed therebetween are a multitude of bristles that facilitate the cleansing action. Each of these bristles and nipples seem to synergise their respective effects while at the same time accomplishing their individual purposes.

While the below drawings illustrate various preferred embodiments of the invention, several modifications can be incorporated into the brush-massager unit. The curvature of the brush as illustrated herein curves into the back at its extreme terminal portions, i.e., in a concave manner. The curvature of the entire device or the handle can also be in the opposite direction wherein the extreme terminal portions curve away from the back of the user, i.e., in a convex manner. In the illustrated version of the present invention, the disc brush or bristle surface is on the same side as the concavity of the handle. In the opposite curvature version, the bristle face will be on the convex surface of the handle curve.

The handle and disc support means of this invention may be hollow and contain means for dispensing liquid soap or other suitable liquids. Also, a provision may be made in the disc support element for cake soap to be housed, thereby supplying the same soaping effect as the provision for a receptacle for liquid soap.

DESCRIPTION OF THE PREFERRED EMBODIMENT AND DRAWING

Figure 1:
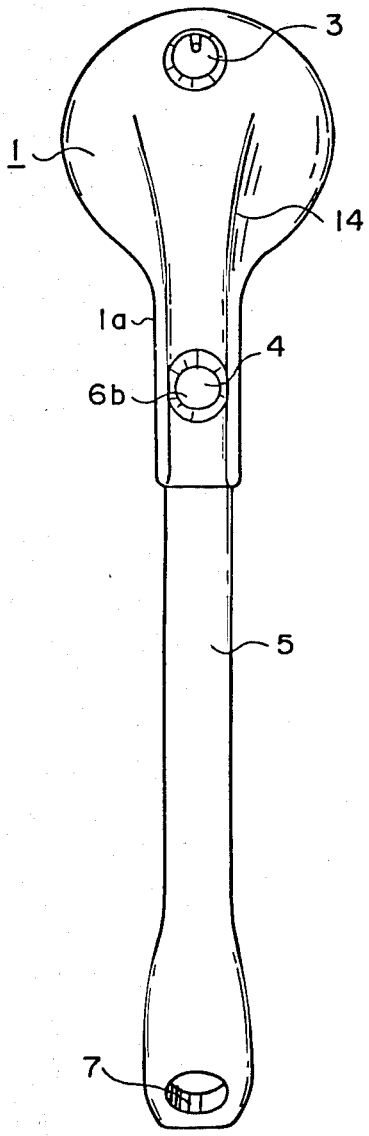
FIG. 1 is a top plan view of a preferred embodiment of this invention in its handle-extended form.
Figure 9:
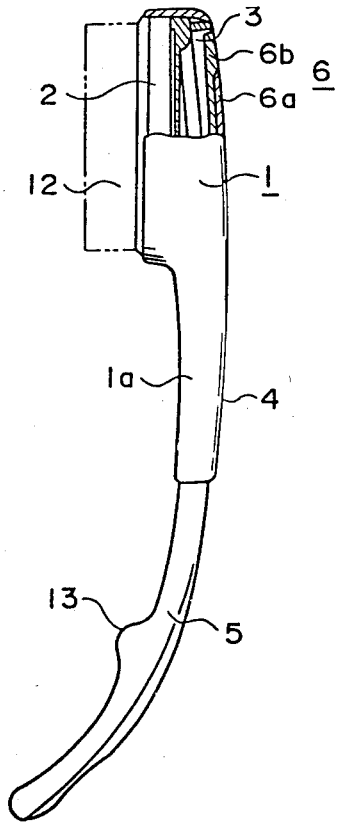
FIG. 9 is a side view of a preferred embodiment of this invention in its handle-shortened form.

In FIG. 1, the brush massager is made up of two basic parts, the disc support means 1 and the handle means 5. Handle means 5 fits into disc support 1 to form the complete brush massager of this invention. Disc support 1 has at its upper portion an aperture 3 and at its lower neck portion 1*a* a lower aperture 4. Neck portion 1*a* and raised portion 14 may be used as a hand grip if the brush massager is ever used without handle portion 5. In FIG. 1, the complete unit is shown with the handle 5 in its longest extension whereby a button 6*b* is mated with lower aperture 4 to lock the brush massager in its extended form. Button 6*b* is spring loaded as an integral part of handle 5 and may be snapped into aperture 4 when the long brush massager is desired. In this form, upper aperture 3 is empty since the upper portion of handle 5 is locked into lower aperture 4. To shorten the handle one needs merely to push down on button 6*b* and push the handle up until button 6*b* locks with upper aperture 3 (as shown in FIG. 9).

Figure 2:
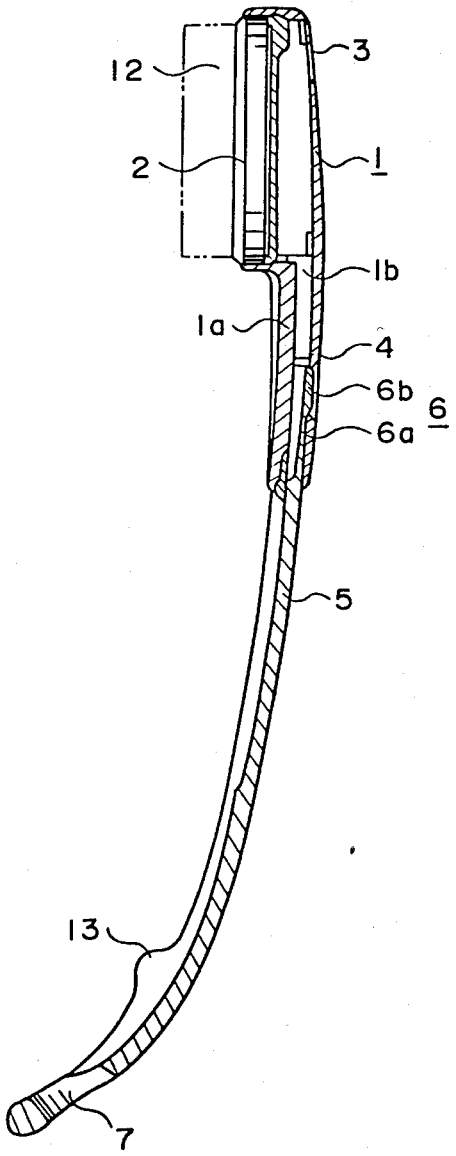
FIG. 2 is the corresponding side view of a preferred embodiment of this invention in its handle-extended form.

In FIG. 2 the same extended version of the brush massager is illustrated in a side view. Disc 12 is more specifically illustrated in FIG. 7 and 8. Handle 5 contains a raised hand grip portion 13 that facilitates a firm grip and control of the brush-massager. Below grip portion 13 is located an aperture 7 that is used to hang the unit up when not in use. Button 6*b* is shown locked into aperture 4 which is about half way up in neck portion 1*a*. Button 6*b* is integral with handle 5 and spring loaded via spring means 6*a*. When button 6*b* is pushed down, spring or flexible means 6*a* is depressed away from the hole or aperture 4 and frees the handle for either upward or downward movement. Neck 1*a* is hollow and contains a handle movement tunnel 1*b* through which handle 5 may move when pushed upward to form the shorter version of the brush-massager. When it is desired to detach handle 5 from disc support 1, the button 6*b* is pushed down and handle 5 pulled out from disc support 1. The base 2 supports and contains the lower portion of the bristles 11 and nipples 10, and is integral with disc support 1. Base 2 is made of rubber or other suitable materials and imparts a soothing flexible feel to the entire face of the disc when in use.

Figure 3:
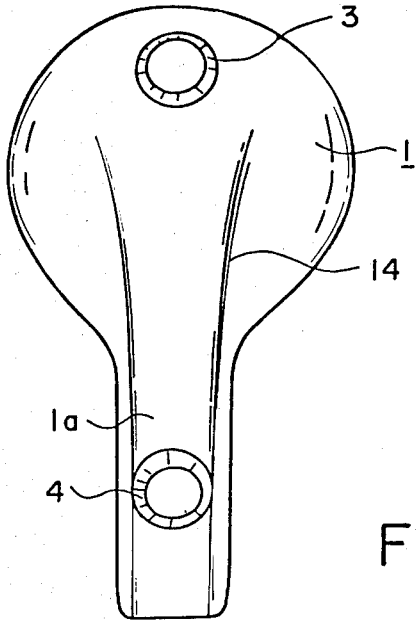
FIG. 3 is a top plan view of the disc support element of this invention.
Figure 4:
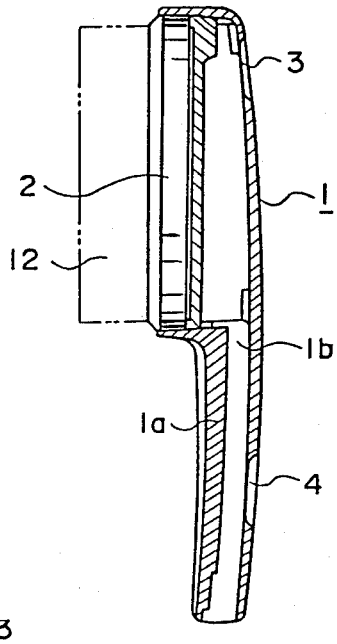
FIG. 4 is the corresponding side view of the disc support element of this invention.

FIGS. 3 and 4 illustrate the disc support 1 detached and separated from handle means 5. Both apertures 3 and 4 are empty since the button and handle have been removed therefrom. Neck portion 1*a* is shown with a hollow portion or tunnel 1*b* through which the handle slides into or out of. The inner portion of handle 5 has a configurational cross section similar to an inverted "U" and adapted to fit closely into tunnel 1*b*. This mating configuration can be seen in FIG. 8 to fit into tunnel 1*b*. Disc 12 is generally shown attached to flexible base 2. The disc support as shown in FIGS. 3 and 4 could be used as is as a brush-massager when use of the handle 5 is not required.

Figure 5:
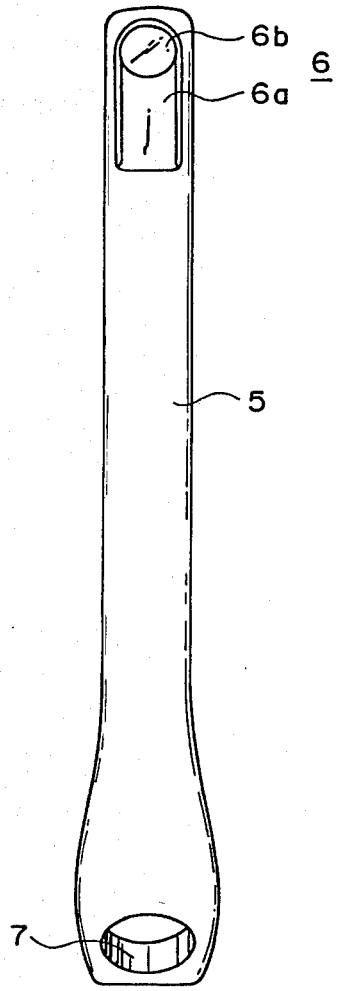
FIG. 5 is a top plan view of the handle portion of this invention.
Figure 6:
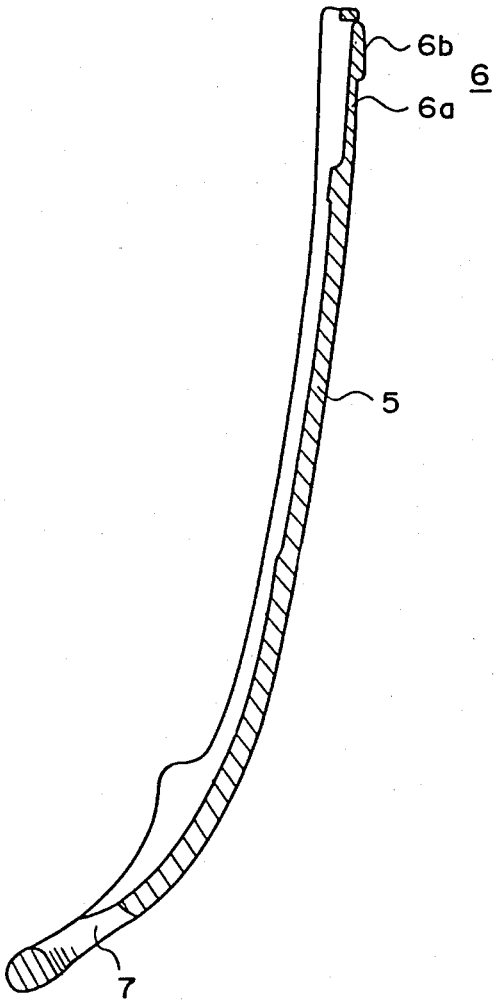
FIG. 6 is the corresponding side view of the handle portion of this invention.

FIGS. 5 and 6 show the handle 5 of this invention detached from and separated from the disc support 1. In handle 5 is shown button 6*b* integral with and spring loaded upon flexible button support 6*a*. By pushing down on button 6*b*, flexible support 6*a* will move downward to release the handle 5 from the disc support 1 and permit its release therefrom.

Figure 7:
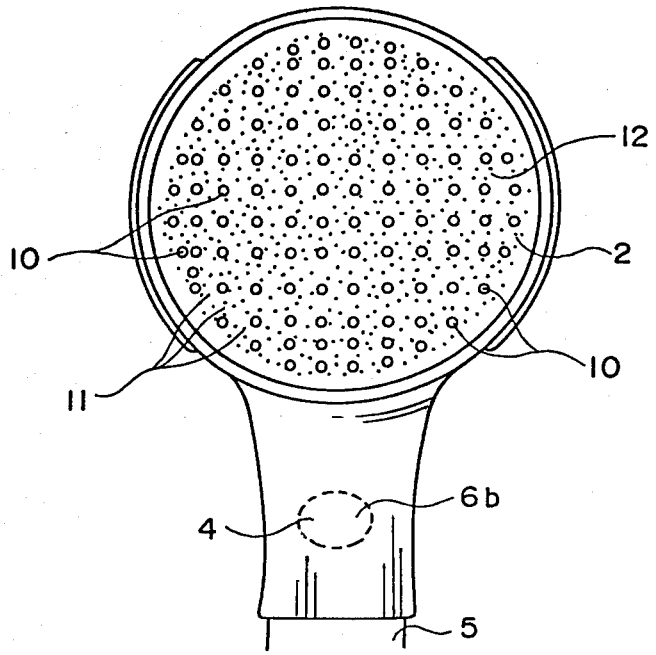
FIG. 7 is a top front view of the disc bristle face of this invention.
Figure 8:
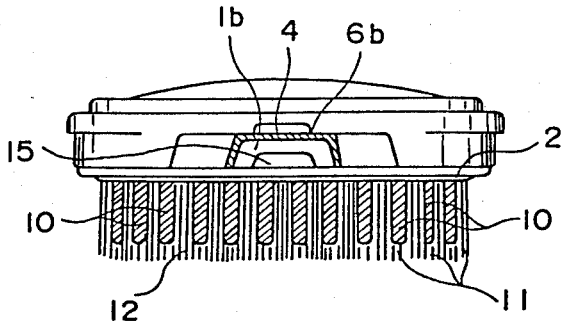
FIG. 8 is the corresponding side view of the disc bristle face of this invention.

FIGS. 7 and 8 show the disc face 12 of the brush massager. Button 6*b* is shown engaged into aperture 4 thereby locking the disc support 1 into handle 5. On the face of disc 12 are a plurality of bristles 11 and raised projections or nipples 10. The action by both the nipples 10 and bristles 11 is a complete cleansing-massaging effect. Tunnel 1*b* facilitates the entrance of handle 5 and is shown in FIG. 8, without the handle 5 inserted therein. Button 6*b* would not be present without the handle 5, but is shown in FIG. 8 only to illustrate its raised position if handle 5 was connected. Tunnel guide 15 runs substantially the length of tunnel 1*b* and facilitates the alignment of handle 5 when inserted into disc support 1. This guide 15 must be present for proper support.

FIG. 9 shows the brush massager of this invention in its short form whereby button 6*b* is locked into upper aperture 3, and aperture 4 is empty.

Although two apertures are shown in the disc support means of this invention, any number of apertures may be used depending upon the various lengths desired. The components of the brush-massager of this invention may be constructed of any suitable material including plastics, fiber glass, synthetic materials, light weight metals, or ceramics; plastics, such as polycarbonates, polyurethanes, polyvinyl materials, other aromatic polymers, alipbatic polymers.

The bristles may be natural or synthetic bristles, and any suitable known bristle may be used. The flexible base and nipples or flexible projecting portions adjacent to the bristles may be made of any suitable material such as rubber, both natural and synthetic, polymeric compounds that are flexible, or mixtures thereof.

Although the present invention is specifically described herein, various modifications will become apparent to those skilled inthe art; these are intended to be included within this invention.

What is claimed is:

1. A brush-massager device comprising a detachable disc support unit and a movably connecting handle means, said disc support unit having an internal tunnel running longitudinally through substantially the length of said unit, said tunnel adapted to receive and lock with said handle means, said tunnel having apertures at its upper and lower portions, said handle means having a spring-loaded button at substantially it supper terminal portion wherein said spring loaded button locks with said upper aperture in a first position and with said lower aperture in a second position, said disc support further comprising a face having raised flexible projections interspersed with a plurality of bristles, and said handle means adapted to slide into and out said tunnel in said disc support.

2. The device of claim 1 wherein said handle means is curved in a direction toward the face of said disc support.

3. The device of claim 1 wherein said button is integral with said handle means and in springing relationship therewith.

4. The device of claim 1 wherein said handle means comprises at its lower portion a hand grip means adapted to facilitate easy control in using said device.

5. The device of claim 1 wherein said handle has a width slightly less than the lower width of said disc support, said disc support adapted to receive internally said handle and lock therewith.

6. The device of claim 1 wherein said disc support has an aperture at its upper portion and an aperture at its lower portion, each of said apertures opening into said tunnel and having a circumference slightly larger than that of said spring loaded button and adapted to receive and lock with said button when aligned therewith.

7. The device of claim 1 wherein said internal tunnel contains a tunnel guide running substantially the length of said tunnel, said guide adapted to facilitate proper strength and alignment of said handle when inserted into said disc support.

8. The device of claim 1 wherein said disc support face comprises a plurality of raised flexible projections interspersed with a plurality of bristle means, said projections all integral with and projecting upward from a flexible base, said flexible base permanently connected to said disc support and comprising the face portion thereof.

9. The device of claim 1 wherein said disc support face comprises a flexible base having projecting thereform and integral therewith a plurality of raised flexible nipples, said flexible base having between said nipples a plurality of openings through which bristles may be permanently affixed.

10. The device of claim 1 wherein said disc support face comprises a flexible base having integral therewith raised flexible projections and a plurality of bristles, said disc support on the side opposite its face portion having therein said two apertures adapted to lock said handle into two length positions.

* * * * *